US011377879B2

(12) United States Patent
Borlodan et al.

(10) Patent No.: US 11,377,879 B2
(45) Date of Patent: Jul. 5, 2022

(54) MOTOR VEHICLE LATCH

(71) Applicant: Kiekert Aktiengesellschaft, Heiligenhaus (DE)

(72) Inventors: Stelian Borlodan, White Lake, MI (US); Jim Zhuang, Canton, MI (US); Keith Robertson, Livonia, MI (US)

(73) Assignee: Kiekert AG, Heiligenhaus (DE)

( * ) Notice: Subject to any disclaimer, the term of this patent is extended or adjusted under 35 U.S.C. 154(b) by 280 days.

(21) Appl. No.: 16/721,848

(22) Filed: Dec. 19, 2019

(65) Prior Publication Data

US 2021/0189772 A1 Jun. 24, 2021

(51) Int. Cl.
*E05B 77/10* (2014.01)
*E05B 85/02* (2014.01)

(52) U.S. Cl.
CPC ..... *E05B 77/10* (2013.01); *E05B 85/02* (2013.01)

(58) Field of Classification Search
CPC ..... E05B 77/10; E05B 85/02; E05B 77/04; E05B 85/26; Y10S 292/23; Y10S 292/51; Y10S 292/55; B60N 2/366
See application file for complete search history.

(56) References Cited

U.S. PATENT DOCUMENTS 9,222,288 B2 * 12/2015 Townson ..... E05B 79/04
2011/0031765 A1 * 2/2011 Vazquez ..... E05B 85/26 292/217
2013/0199103 A1 * 8/2013 Raschegewski ..... E05B 77/34 49/506
2013/0300137 A1 * 11/2013 Akizuki ..... E05B 85/26 292/337
2019/0085602 A1 * 3/2019 Borlodan ..... B60N 2/366

FOREIGN PATENT DOCUMENTS

DE 102007033369 4/2008
DE 102013111395 4/2015
DE 102013111395 A1 * 4/2015 ..... B21D 49/00
WO 2017054790 4/2017
WO 2019058166 A1 3/2019

OTHER PUBLICATIONS

International Search Report dated Mar. 29, 2021, for corresponding International Patent Application No. PCT/IB2020/061808.
Written Opinion dated Mar. 29, 2021, for corresponding International Patent Application No. PCT/IB2020/061808.

* cited by examiner

*Primary Examiner* — Christine M Mills
*Assistant Examiner* — James Edward Ignaczewski
(74) *Attorney, Agent, or Firm* — Renner, Otto, Boisselle & Sklar, LLP

(57) ABSTRACT

A motor vehicle latch, in particular a motor vehicle side-door latch, comprising a latch plate and comprising a locking mechanism which is mounted on the latch plate and consists substantially of a catch and pawl. The latch plate has an inlet jaw for a latch holder that enters therein and interacts with the locking mechanism. The inlet jaw is reinforced by a circumferential flange. According to the invention, the flange has at least one interruption which completely or partially reduces its installation height in order to compensate for deformations of the latch plate caused by tensile forces.

20 Claims, 3 Drawing Sheets

MOTOR VEHICLE LATCH

The invention relates to a motor vehicle latch, in particular a motor vehicle side-door latch, comprising a latch plate and a locking mechanism mounted on the latch plate, the locking mechanism consisting substantially of a catch and pawl, the latch plate being provided with an inlet jaw for a latch holder that enters therein and interacts with the locking mechanism, and the inlet jaw being reinforced by a circumferential flange.

The latch plate, as with the latch case, is usually produced from solid steel as a component of such motor vehicle latches in order to absorb forces occurring when the motor vehicle latch is closed in conjunction with the locking mechanism and the latch holder and to divert the forces into the vehicle body. This applies in particular to extreme situations such as an accident, in which tearing forces acting on the locking mechanism must be absorbed. In order to ensure sufficient safety in such accident situations or simply in general, tensile tests are carried out in which the motor vehicle latches are subjected to a load comparable to an accident.

In these tensile tests, in particular forces or tensile forces acting on the motor vehicle latch are simulated in the transverse or Y-direction of the vehicle. This can be attributed to the fact that the latch case and the latch plate connected thereto are usually oriented in said transverse direction of the vehicle in particular in the case of motor vehicle side-door latches, and tearing forces acting on an associated motor vehicle door act primarily in this direction. These tearing forces naturally have to be controlled in order to ensure the stability of the vehicle body on account of the closed motor vehicle doors, and to optimally protect the vehicle occupants located inside by means of the safety systems installed in the vehicle doors.

The prior art according to WO 2017/054790 A1 already provides approaches for ensuring the required safety in a simple embodiment. For this purpose, the known teaching involves a chamfer being provided opposite the inlet slot or inlet jaw, which chamfer is formed as semicircle in an opposite end region. Overall, a motor vehicle latch is provided which can absorb the greatest loads at the lowest possible weight. In fact, maximum forces of approximately 13.6 kN in the transverse direction of the motor vehicle or in the previously mentioned Y-direction are observed at this point, specifically 0.05 seconds after the introduction of force. This concept has proven itself in principle.

The generic prior art according to DE 10 2013 111 395 A1 generally involves a method for producing a rear metal sheet or a latch case. This involves an associated sheet-metal blank being cold-worked such that a thickened edge region having locally increased sheet strength is produced by material displacement. This approach is intended to reduce production costs while retaining a high level of mechanical stability.

In a further known method for sheet-metal working, as described by DE 10 2007 033 369 A1, an undesired warpage is intended to be compensated for. For this purpose, at least one compensating notch is made in the sheet-metal part. This is intended to increase the dimensional accuracy during manufacture by simple means.

The prior art has proven itself in principle; this is in regards to the optimal design, in terms of both safety and weight, of the latch case or latch plate of in particular motor vehicle side-door latches. Nevertheless, for practical reasons there has increasingly been a need to increase the tearing forces absorbed by the motor vehicle latch, in particular in the transverse or Y-direction of the vehicle. This essentially comes down to two aspects. Firstly, the weight of vehicles has been increasing continuously for years. This also means that the speeds achieved have grown considerably, and therefore tearing forces acting on the motor vehicle latch that are higher than previously was the case can be expected in particular in the case of an accident. The invention as a whole aims to provide a remedy to this situation.

The technical problem addressed by the invention is that of developing a motor vehicle latch of this kind, in particular a motor vehicle side-door latch, so as to meet safety requirements that are further enhanced compared with the prior art.

In order to solve this technical problem, the invention proposes, for a generic motor vehicle latch, and in particular a motor vehicle door latch, that the circumferential flange reinforcing the inlet jaw has at least one interruption which completely or partially reduces its installation height in order to compensate for deformations of the latch plate caused by tensile forces.

Usually at this point at least two or more interruptions are provided in the flange in question which circumferentially reinforces the inlet jaw. In this connection, the two interruptions can be at a distance which is greater than the relevant penetration depth thereof into the flange.

As such, by means of the interruption or the two interruptions produced according to the invention, the installation height of the flange is completely or partially reduced in this region. A penetration depth in the flange corresponds to this. The interruption is usually in fact a notch which is made in the flange in question, usually using a notching tool.

As is conventional, the notch is an artificial, wedge-shaped incision which is made in the circumferential flange reinforcing the inlet jaw by means of the notching tool. In principle, however, the invention also includes interruptions which do not correspond to a tapering incision, but correspond rather to a rectangular incision, for example. Either way, the installation height of the flange is completely or partially reduced in the region of the interruption, preferably the notch, which corresponds to a corresponding penetration depth of a notching tool typically used for this purpose.

The distance between the two interruptions can be at least 1.5 times the relevant penetration depth according to an advantageous embodiment. In addition, it has proven advantageous for the interruption in question to be provided at an edge of the inlet jaw facing a pawl bearing pin. In this respect, the invention is generally based on the knowledge that, when there is force acting on the motor vehicle latch according to the invention, in particular a motor vehicle door latch, usually in the Y or transverse direction of the vehicle, the forces associated therewith are transferred from the latch holder to the catch and finally from the catch to the pawl securing the catch. Consequently, significant transverse forces act on both a catch bearing pin and the pawl bearing pin. This is because the pins extend in the longitudinal or X-direction of the vehicle. These transverse forces result in the latch case or latch plate being deformed or bent.

Since the catch is additionally twisted out of engagement with the pawl in this process, the forces acting on the pawl bearing pin tend to be greater at this point than in the region of the catch bearing pin and lead to greater deformation of the latch case or latch plate here. The invention takes account of this increased deformation of the latch plate in the region of the pawl bearing pin in that the circumferential flange reinforcing the inlet jaw can follow these deformations. This has been ensured by the at least one interruption, which allows bending of the latch plate in particular in the region of the edge facing the pawl bearing pin. Consequently, the relevant deformations of the latch plate are controlled in particular in this region of the edge facing the pawl bearing pin as a result of the acting forces.

In fact, the interruption or the relevant notch ensures that the flange circumferentially reinforcing the inlet jaw continues to ensure the required stiffness in this region and increases the stiffness of the latch plate and thus the latch case. Nevertheless and in addition, deformations are permitted which are caused in particular by the transverse forces acting on the two pins. This is ensured by the targeted material weaknesses in the flange in the form of the interruptions or notches. Since the greatest deformations of the latch plate are observed in the region of the pawl bearing pin, the at least one interruption is located at the edge facing the pawl bearing pin.

Consequently, maximum forces that can be absorbed by the motor vehicle latch according to the invention are considerably above the 13.6 kN and 16.7 kN specified in the prior art according to WO 2017/054790 A1. In fact, tearing forces or maximum forces which are achieved according to the invention for correspondingly acting tensile forces in the transverse or Y-direction of the vehicle are observed which usually significantly exceed 20 kN. In fact, values of 24 kN or even more can be realized in this case, so that safety is considerably increased.

The situation whereby the circumferential flange reinforcing the inlet jaw is usually U-shaped in cross section also contributes to this. This U-shaped design of the flange in cross section increases the reinforcing effect thereof as a whole because such a flange counters deformations of the latch plate with a higher section modulus compared, for example, with an arched flange as in the prior art according to DE 10 2013 111 395 A1.

Furthermore, it has proven advantageous for the flange to surround the inlet jaw in the manner of a U in plan view. In order to reinforce in particular the region of the pawl bearing pin, the flange is also advantageously provided with an extension in the direction of an edge of the latch plate. This extension is usually oriented toward a lower edge of the latch plate, and thus toward a region in which the pawl bearing pin is located or is anchored in the latch plate.

The latch case itself is, as with the latch plate, generally planar for the most part. In addition, it has proven advantageous for the latch case to also be punched from sheet steel and optionally deep-drawn, as with the latch plate. In fact, the various forming steps can usually be carried out in one or more work steps because conventional machining steps such as punching, deep-drawing and also, as according to the invention, notching are usually used.

The result is a motor vehicle latch which meets enhanced safety requirements compared with the prior art. In fact, the motor vehicle latch according to the invention makes it possible to control tearing forces, in particular forces in the transverse direction of the vehicle, which are considerably greater than those which could hitherto be absorbed by conventional motor vehicle latches. This can essentially be attributed to the fact that a deformation of the latch plate is deliberately permitted, and, for this purpose, the flange circumferentially reinforcing the inlet jaw is provided with the at least one interruption or notch in order to compensate for such deformations. It has surprisingly been found that by means of such a simple process, namely forming the interruption or notch, the maximum forces that can be absorbed by a motor vehicle latch modified in this way could be considerably increased compared with the prior art in the case of a tear test.

All of this can be achieved using a production process that is only slightly modified and which usually provides at least one additional notch in the circumferential flange around the inlet jaw. As a result, overall, manufacturing costs are expected to be low and the weight is expected to remain the same compared with the prior art, which, in conjunction with the enhanced safety requirements, offers a considerable advantage. This is where the essential advantages are to be seen.

The invention will be described in the following on the basis of an exemplary embodiment which simply describes a motor vehicle latch in more detail. In the drawings.

Figure 1:
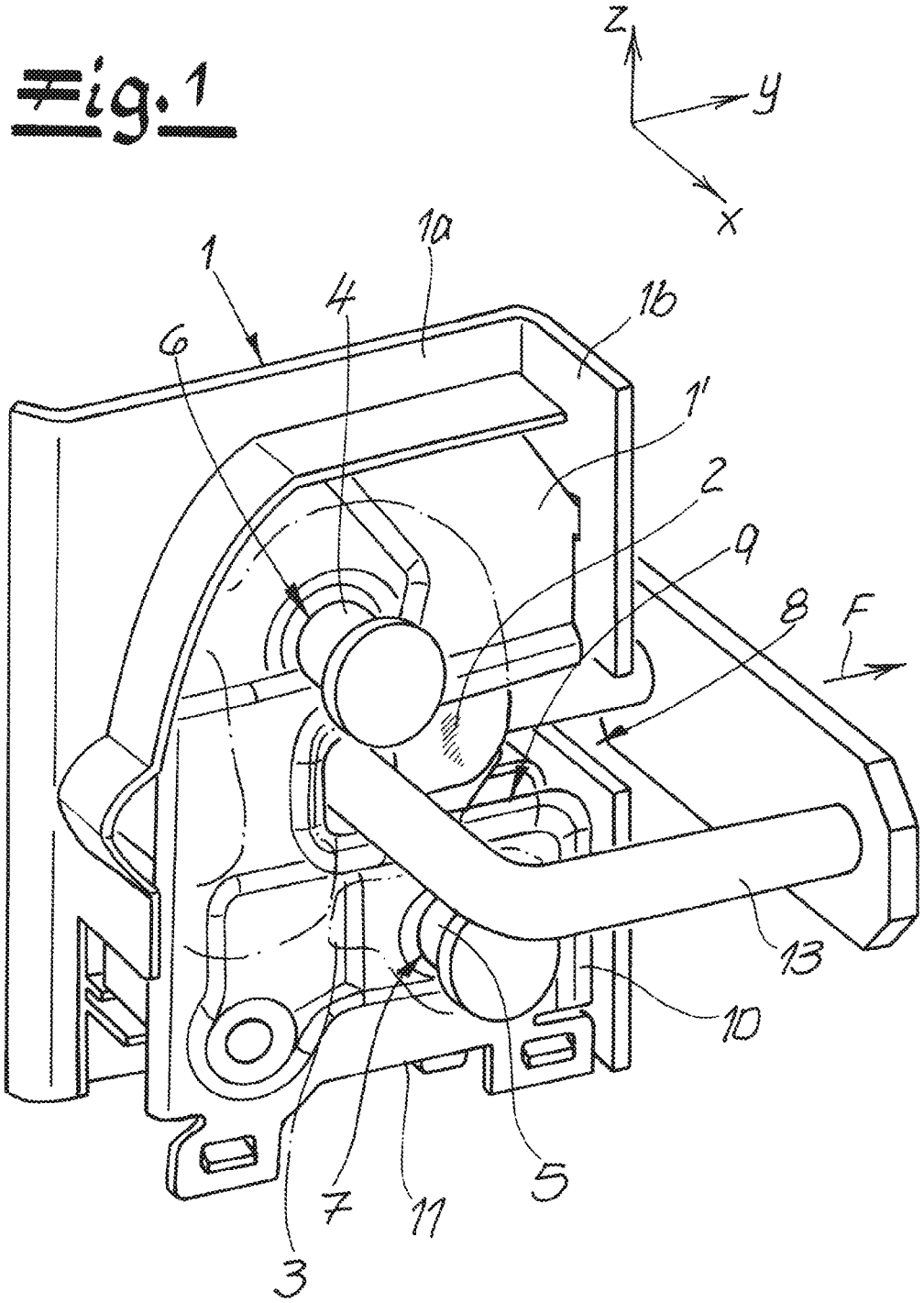
FIG. 1 is a perspective overview of the motor vehicle latch.

A motor vehicle latch is shown in the drawings. The motor vehicle latch shown is a motor vehicle side door latch, i.e. a motor vehicle latch installed into a motor vehicle side-door or onto such a motor vehicle side-door. The shown use of the motor vehicle latch as a motor vehicle side door latch is intended as an example only, the motor vehicle latch can be used for other motor vehicle doors, for example rear doors, or for motor vehicle hoods, slidings door etc. The motor vehicle latch has a latch case 1 and a latch plate 1' as essential structural elements. It can be seen from the drawings that the latch case 1 is L-shaped in cross section and has a long L-leg 1*a* and a short L-leg 1*b* for this purpose. The latch case 1 is in this case oriented in the motor vehicle in or on the motor vehicle side-door in question such that the long L-leg 1*a* extends substantially in the transverse or Y-direction of the vehicle indicated in FIG. 1. On the other hand, the short L-leg 1*b* is oriented in the longitudinal or X-direction of the vehicle. In addition, the vertical axes or Z-direction of the vehicle are also indicated in FIG. 1. The latch plate 1' extends in parallel with the long L-leg 1*a* of the latch plate 1 and is joined thereon so as to house a locking mechanism 2, 3.

The latch case 1 and the latch plate 1' are used to mount the locking mechanism 2, 3 consisting substantially of a catch 2 and at least one pawl 3. In principle, a multi-pawl locking mechanism could also be mounted in the latch case 1. For this purpose, the catch 2 has a catch bearing pin 4 and the pawl has a pawl bearing pin 5. The catch bearing pin 4 is anchored in an opening 6 in the latch case 1 and the latch plate 1'. In order to anchor the pawl bearing pin 5, a further opening 7 is provided in the latch case 1 and the latch plate 1' and can be seen in particular in FIGS. 2 and 3. The two pins extend primarily in the X-direction.

The latch case 1 and the latch plate 1' are provided with an inlet jaw 8 via which a latch holder 13 can enter and interact with the locking mechanism 2, 3 in a known manner. While the described motor vehicle latch is usually fastened in or on the motor vehicle side-door, the latch holder 13 is often on the vehicle-body side, so that, when the motor vehicle door is closed with respect to the vehicle body, the latch holder 13 automatically enters the locking mechanism 2, 3 via the inlet jaw 8 and is retained by the catch 2, which itself is secured by means of the latching pawl 3.

A circumferential flange 9 on the latch plate 1', which reinforces the inlet jaw 8 and is shown in particular in the figures, is of particular significance for the invention. It can in fact be seen from FIG. 2 that the flange 9 is approximately U-shaped in plan view and surrounds the inlet jaw 8. In addition, the flange 9 according to the exemplary embodiment is also provided with an extension 10 in the direction of an edge 11 of the latch plate 1'. The edge 11 of the latch plate 1' is an edge which faces the pawl bearing pin 5 or the opening 7 in the latch plate 1' which accommodates said pin, which edge constitutes a lower edge when the motor vehicle latch is installed.

Figure 2:
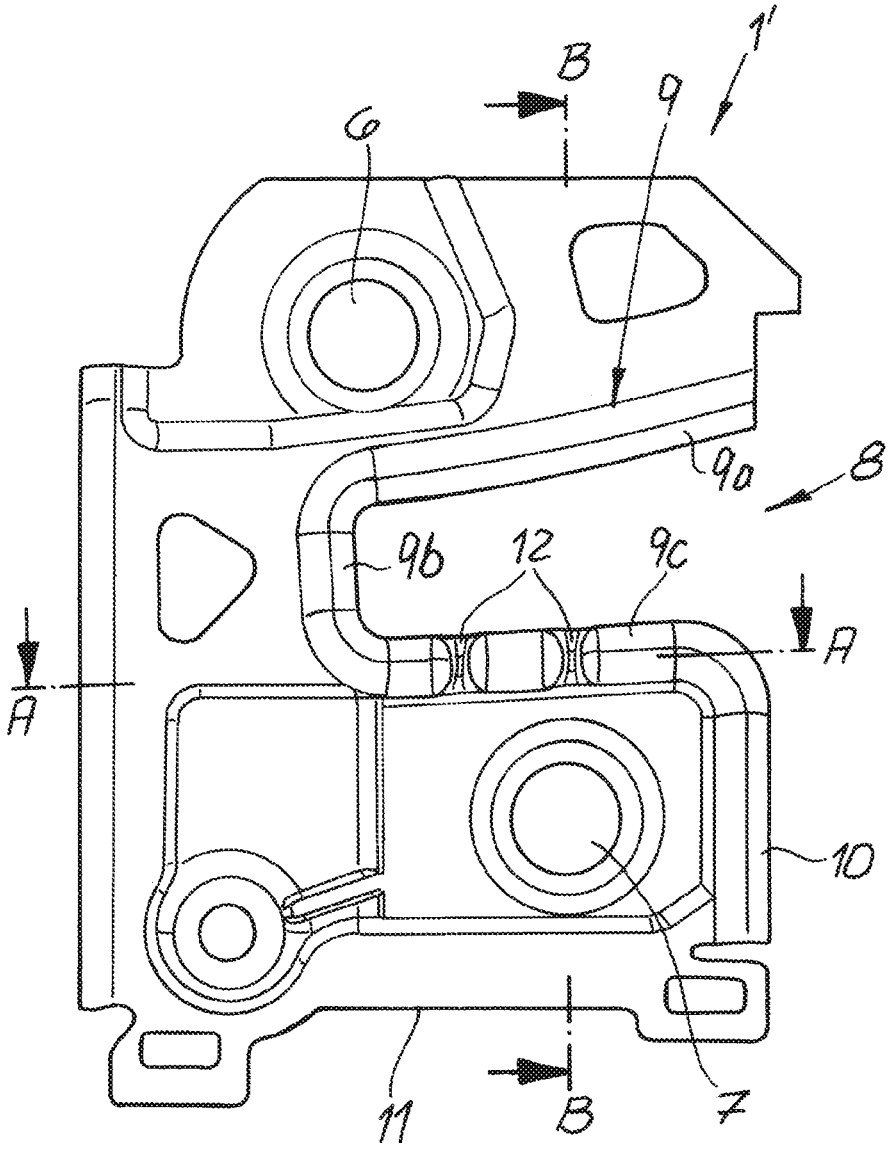
FIG. 2 is a plan view of the associated latch plate of the motor vehicle latch according to FIG. 1
Figure 3:
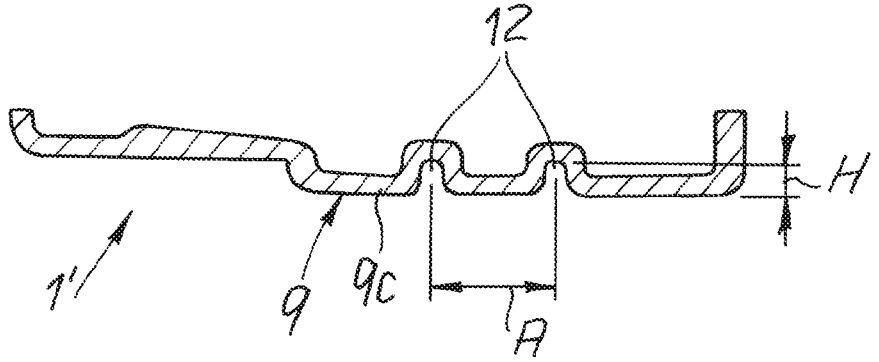
FIG. 3 is a cross section through the latch plate according to FIG. 2 along the line A-A
Figure 4:
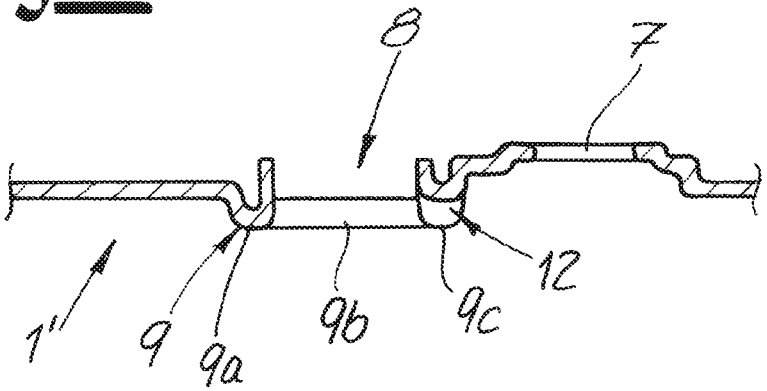
FIG. 4 is a cross section through the latch plate according to FIG. 2 along the line B-B.

According to the invention, this flange 9 is provided with at least one interruption 12 which can be seen in plan view in FIG. 2 and can be seen in cross section in FIGS. 3 and 4. In fact, two interruptions 12 are produced at this point, as is made clear in particular by the longitudinal cross section through the flange 9 according to the view in FIG. 3.

Deformations of the latch plate 1', and thus also of the latch case 1, caused by tensile forces F are compensated for by means of the one or the two interruptions 12. The tensile forces F are those which act on the motor vehicle latch in the Y or transverse direction of the vehicle according to the view in FIGS. 1 and 2 and which are effective in a direction corresponding to a door being opened. Consequently, the latch holder 13 acts on the catch 2 in the opening sense, which catch is secured by the pawl 3 in the shown closed position of the locking mechanism 2, 3.

The forces F acting at this point, as already described at the outset, ensure that the latch plate 1' is deformed by means of the associated catch bearing pin 4 and also the pawl bearing pin 5. In this process, the deformation tends to be greater in the region of the pawl bearing pin 5 than in the region of the catch bearing pin 4, as has already been mentioned at the outset. The invention takes account of this in that the two interruptions 12 are provided at an edge 9*c* of the circumferential flange 9 facing the pawl bearing pin 5. In fact, the flange 9 has the aforementioned U-shaped nature with an edge 9*a* facing the catch bearing pin 4 or the opening 6 accommodating said pin, with a further edge 9*b* which restricts the movement of the latch holder 13 within the inlet jaw 8 and extends perpendicularly thereto, and finally with the aforementioned edge 9*c* facing the pawl bearing pin 5 or the opening 7 in the latch plate 1' accommodating said pin.

It can be seen from FIGS. 3 and 4 that the flange 9 is U-shaped in cross section overall. In addition, the relevant interruption 12 is defined in the flange 9 such that it completely or partially reduces its installation height H shown in FIG. 3. It can be seen from FIG. 3 that the installation height H is fully or completely reduced in the region of the interruption 12, i.e. in the region of the interruption 12 the flange 9 ultimately does not have an installation height H. The interruption 12 in the context of the exemplary embodiment is advantageously a notch, i.e. a largely wedge-shaped incision which is made in the flange 9 by means of a notching tool, whereby in the present case the penetration depth of the notching tool corresponds to the installation height H.

It can also be seen from FIGS. 3 and 4 that the two interruptions 12 are at a distance A which in the exemplary embodiment is greater than the relevant penetration depth thereof in the flange 9, which presently corresponds to the installation height H. This means that the following applies:

$$A > H.$$

The distance A can in fact often even be at least 1.5 times the relevant penetration depth.

As explained above, the latch case 1 is L-shaped in cross section or is of a largely planar nature. In addition, the latch case 1 and the latch plate 1' are usually made from sheet steel, with various established production methods, such as punching, deep-drawing and notching, being combined in this respect. The above-described extension 10 of the flange 9 in the direction of the edge 11 ensures overall that the latch plate 1' is additionally reinforced in the region of the pawl bearing pin 5 or the opening 7 accommodating said pin. Nevertheless, the interruptions 12 or notches made at this point allow deformations of the latch plate 1' in this region, so that the high forces F described at the outset can be absorbed in particular in the transverse or Y-direction of the vehicle.

The invention claimed is:

1. A motor vehicle latch for a motor vehicle side-door, the motor vehicle latch comprising:

a latch plate; and a locking mechanism mounted on the latch plate, said locking mechanism consisting of a catch and at least one pawl, said latch plate having an edge defining an inlet jaw for a latch holder that enters therein and interacts with the locking mechanism, and a circumferential flange extending from the edge inwardly into the inlet jaw configured to reinforce the inlet jaw, wherein the flange has at least one interruption portion which extends from an end of the flange toward the edge, wherein the at least one interruption portion completely or partially reduces an installation height of the flange with respect to the inlet jaw to compensate for deformations of the latch plate caused by tensile forces.

2. The motor vehicle latch of claim 1, wherein the flange has two interruption portions.

3. The motor vehicle latch of claim 2, wherein the two interruption portions are spaced by a distance greater than a penetration depth thereof in the flange.

4. The motor vehicle latch of claim 3, wherein the distance is at least 1.5 times the penetration depth.

5. The motor vehicle latch of claim 1, wherein the at least one interruption portion is formed at an edge of the inlet jaw facing a pawl bearing pin.

6. The motor vehicle latch of claim 1, wherein the flange is U-shaped in cross-section.

7. The motor vehicle latch of claim 1, wherein the flange surrounds the inlet jaw in a U-shape.

8. The motor vehicle latch of claim 1, wherein the flange has an extension in a direction of an edge of the latch plate.

9. The motor vehicle latch of claim 1, wherein the latch plate is largely planar.

10. The motor vehicle latch of claim 1, wherein the at least one interruption portion is formed as a notch.

11. The motor vehicle latch of claim 2, wherein the two interruption portions are formed at an edge of the inlet jaw facing a pawl bearing pin.

12. The motor vehicle latch of claim 2, wherein the flange is U-shaped in cross-section.

13. The motor vehicle latch of claim 2, wherein the flange has an extension in a direction of an edge of the latch plate.

14. The motor vehicle latch of claim 3, wherein the flange is U-shaped in cross-section.

15. The motor vehicle latch of claim 3, wherein the flange surrounds the inlet jaw in a U-shape.

16. The motor vehicle latch of claim 6, wherein the flange has an extension in a direction of a second edge of the latch plate.

17. The motor vehicle latch of claim 7, wherein the flange has an extension in a direction of an edge of the latch plate.

18. The motor vehicle latch of claim 1, wherein the at least one interruption portion is formed as a wedge-shaped incision.

19. The motor vehicle latch of claim 1 further comprising a latch case connected to the latch plate.

20. A method of forming a motor vehicle latch, the method comprising:

punching a latch plate from a sheet steel material;

deep-drawing the latch plate, wherein a locking mechanism is mounted on the latch plate and includes a catch and at least one pawl, the latch plate having an edge defining an inlet jaw for a latch holder that enters therein and interacts with the locking mechanism, and a circumferential flange extending from the edge inwardly into the inlet jaw configured to reinforce the inlet jaw; and notching the latch plate to form at least one interruption portion on the flange which extends from an end of the flange toward the edge, wherein the at least one interruption portion completely or partially reduces an installation height of the flange with respect to the inlet jaw to compensate for deformations of the latch plate caused by tensile forces.

* * * * *